US007618066B2

(12) United States Patent
Baldus et al.

(10) Patent No.: US 7,618,066 B2
(45) Date of Patent: Nov. 17, 2009

(54) PHOTOENGRAVED PRINTED DATA CARRIER

(75) Inventors: Christof Baldus, München (DE); Daniel Franz, Ismaning (DE); Adolf Preidt, Olching (DE); Theodor Rebele, München (DE)

(73) Assignee: Giesecke & Devrient GmbH, München (DE)

( * ) Notice: Subject to any disclaimer, the term of this patent is extended or adjusted under 35 U.S.C. 154(b) by 940 days.

(21) Appl. No.: 10/239,179

(22) PCT Filed: Mar. 26, 2001

(86) PCT No.: PCT/EP01/03418

§ 371 (c)(1),
(2), (4) Date: Nov. 20, 2002

(87) PCT Pub. No.: WO01/72525

PCT Pub. Date: Oct. 4, 2001

(65) Prior Publication Data

US 2003/0151246 A1 Aug. 14, 2003

(51) Int. Cl.
*B42D 11/00* (2006.01)

(52) U.S. Cl. ..... 283/57; 283/72

(58) Field of Classification Search ..... 283/91, 283/93–94, 81, 57–58, 59; 428/187, 172, 428/211.1–213; 101/150, 170, 395
See application file for complete search history.

(56) References Cited

U.S. PATENT DOCUMENTS 3,599,153 A * 8/1971 Lewis et al. ..... 235/449
3,980,018 A 9/1976 Ieyasu
4,033,059 A * 7/1977 Hutton et al. ..... 283/91
4,588,212 A * 5/1986 Castagnoli ..... 283/91
5,182,063 A * 1/1993 Lang et al. ..... 264/132
5,435,247 A * 7/1995 Giori et al. ..... 101/395
5,487,567 A * 1/1996 Volpe ..... 283/72
5,801,857 A * 9/1998 Heckenkamp et al. ..... 359/2
6,050,606 A * 4/2000 Foresti ..... 283/93
6,227,572 B1 * 5/2001 Lyen ..... 283/58
6,905,755 B1 * 6/2005 Nemeth ..... 428/195.1
6,928,925 B1 * 8/2005 Mayer et al. ..... 101/150

(Continued)

FOREIGN PATENT DOCUMENTS

DE 198 45 436 A 4/2000

(Continued)

OTHER PUBLICATIONS

Definition of contiguous and adjacent from www.yahoo.com Jan. 21, 2008.*

(Continued)

*Primary Examiner*—Dana Ross
*Assistant Examiner*—Jamila Williams
(74) *Attorney, Agent, or Firm*—Bacon & Thomas, PLLC

(57) ABSTRACT

The invention relates to a printed data carrier having a printed surface and at least one printed partial surface enclosed thereby on all sides, the surface and the partial surface being printed by intaglio printing and contrasting visually due to an ink layer of varying thickness. The invention likewise relates to the method for producing the data carrier, the printing plate used therefor, and the method for producing the printing plate.

21 Claims, 8 Drawing Sheets

U.S. PATENT DOCUMENTS

2001/0043842 A1* 11/2001 Kaule et al. ..... 409/132

FOREIGN PATENT DOCUMENTS

| | | |
|---|---|---|
| EP | 0 511 559 | 11/1992 |
| JP | 6-98797 | 4/1994 |
| JP | 2001-269197 | 10/2001 |
| WO | WO 89/11548 | 11/1989 |
| WO | WO 96/17955 | 6/1996 |

OTHER PUBLICATIONS

L. A. Sanguedolce, et al., American Chemical Society, No. 728, pp. 190-204, "Fundamental Studies of DNA Adsorption and Hybridation on Solid Surfaces", 1999.

Patent Abstracts of Japan; vol. 015, No. 1999 (M-1115), May 22, 1991 & JP 03 053970 A (ookurashiyou Insatsu Kyokucho), Mar. 7, 1991.

* cited by examiner

PHOTOENGRAVED PRINTED DATA CARRIER

BACKGROUND OF THE INVENTION

1. Field of the Invention

This invention relates to a data carrier printed by intaglio printing, to the production thereof and to a printing plate suitable therefor and the method for producing said plate.

2. Description of Related Art

Security documents and documents of value, for example bank notes, shares, bonds, certificates, vouchers and the like, which must meet high standards with respect to forgery-proofness, are frequently printed by intaglio printing. This printing process provides a characteristic printed image that is easily recognizable to laymen and cannot be imitated with other common printing processes.

In intaglio printing, surfaces are usually rendered by a line screen, the line distance and width determining the color tone or gray value of the surface. Printed lines are usually a few tenths of a millimeter wide and separated by unprinted areas. During the printing operation, only the depressions formed in the printing plate surface by means of etching or engraving carry ink, while the actual printing plate surface is ink-free. This is obtained by wiping the printing plate surface free of excess ink after inking with a wiping cylinder or doctor blade.

During the actual printing operation the data carrier to be printed is pressed against the printing plate with high pressure by a pressure cylinder with an elastic surface. The at least partly compressible data carrier, usually made of paper, is thereby pressed into the ink-filled depressions of the printing plate and thus comes in contact with the ink. When the data carrier is detached from the printing plate, the latter pulls the ink out of the depressions. A printed image produced in this way has spaced-apart printed lines or areas that are covered with an ink layer of varying thickness in accordance with the depth of the printing plate engraving.

The high bearing pressure additionally causes the substrate material to undergo an embossing that is also noticeable on the back of the data carrier. If the engravings in the printing plate are deep enough, a data carrier printed by intaglio printing acquires through embossing and inking a printed image that forms a relief perceptible with the sense of touch. In the unprinted surface areas of the data carrier not carrying ink, the high pressures during the printing operation act like a calendering, which leads to compression and smoothing of the data carrier surface. These features make prints produced by intaglio printing distinguishable anytime from prints produced by other techniques.

BRIEF SUMMARY OF THE INVENTION

The problem of the present invention is to produce more complex printed images by intaglio printing with elevated protection from forgery.

This problem is solved by the independent claims. Developments are the object of the subclaims.

The inventive data carrier is characterized by a surface printed by intaglio printing and at least one partial surface completely enclosed by said surface, the surface and partial surface being printed with the same ink but having different ink layer thickness so that they contrast visually. A sign represented by the partial surface can be any geometrical element with an e.g. circular, triangular, square or asymmetric contour structure, a pictograph, character or other symbol, preferred characters being in particular alphanumeric characters.

The printed surface and partial surface enclosed thereby on all sides are printed with an ink layer of varying thickness. Since usual intaglio inks are transparent and translucent to a certain degree, suitable layer thicknesses and an expedient choice of background color will result in color or gray tones of varying brightness and color saturation. If there is a sufficient difference of the ink layer thicknesses of adjacent surfaces, readily visible contrasts will result for the human eye without further aids. Normal lighting conditions and a normal viewing distance are assumed here.

The printed surface and partial surface enclosed thereby are in exact register if their position relative to each other is predetermined and adhered to exactly and reproducibly without the slightest deviations. If two printed images produced by successive, mutually independent printing operations are superimposed, this exactly registered positioning of the two surfaces is not possible.

In a preferred embodiment, the printed surface and partial surface are distinguishable not only visually by reason of their contrast but also with the sense of touch, i.e. tactilely. The surface relief produced by the pressure is composed of an embossing of the substrate material and the applied ink layer. The total height of the relief is based on the normal, i.e. unprinted and unembossed, data carrier surface and is at least 25 microns for feelable areas. Relief heights of more than 40 microns are especially preferred since surface elements with such relief heights are especially well perceptible tactilely.

Inventive data carriers have elevated forgery-proofness since the characteristic intaglio printed image makes them unreproducible by common printing processes. If they also have tactilely perceptible surface elements, this provides additional effective protection against imitation by color photocopying or scanning of the data carriers.

In an especially preferred embodiment, the printed surface of the data carrier additionally encloses unprinted partial areas that can in turn have the form of one or different signs of any kind. This permits a third piece of information to be rendered in negative representation, i.e. by unprinted areas in printed surroundings, in addition to the two pieces of information rendered in positive representation, i.e. with inking, in the same surface.

According to a further embodiment, the printed surface can also enclose a plurality of partial surfaces that either all have the same or different ink layer thicknesses. It is likewise possible to provide unprinted areas in the partial areas.

The form of the partial surfaces can be selected at will according to the invention, for example in the form of geometrical patterns, logos or alphanumeric characters.

The various partial surfaces, unprinted areas and the contour form of the printed surface can also be semantically related. For example, it is possible to execute the printed surface in the form of an alphanumeric character and execute the partial surfaces and any unprinted areas present in the printed surface and/or partial surfaces in the form of the same sign. If a plurality of printed surfaces are provided on the data carrier that together represent a readable piece of information, such as a multidigit number or a word, the partial areas and/or unprinted areas within a printed surface can also be executed in the form of this total information. But any other semantic relations are also possible.

The arrangement of the partial surfaces within the printed surface is as desired and subject only to the restriction that the partial surface or surfaces are largely enclosed by the printed surface. If only one partial surface exists within the printed surface, it can for example represent the same information as the printed surface and extend within the printed surface parallel to the outside contour. Preferably, a plurality of partial surfaces are disposed in the printed surface, however. The smaller the partial surfaces are, the greater the number of said partial surfaces can of course be. They can be disposed in the printed surface in any pattern. This pattern can likewise be readable information, or only a regular column and/or row arrangement. If unprinted areas are additionally provided in the printed surface, they can be disposed alternatingly with the partial surfaces.

In the inventive data carriers, unprinted areas and surfaces with varying ink layer thickness adjoin directly and in any order. This makes it possible to render very complex printed images and superimpose a plurality of pieces of information, also in positive representation, on the same surface. The freedom of design in preparing and rendering printed images produced by intaglio printing is thus enormously increased.

The inventive method for producing corresponding printed data carriers has in addition considerable economic advantages since the surfaces provided for printing with different ink layer thicknesses are produced with the same ink in one printing pass. Suitable substrate materials for printing with the inventive method are all those that can be used for intaglio printing, such as paper, plastic foils, paper laminated with plastic foils or lacquered paper, and multilayer composite materials.

The inventive intaglio printing plates are preferably produced by engraving with a fast rotating, tapered graver. In accordance with the contour form of the surface to be printed, corresponding depressions are formed in the surface of the printing plate by the engraving tool with selective variation of the engraving depth and are filled with ink for the printing operation. During printing, the ink is transferred from the depressions of the plate to the surface of a substrate. No ink is transferred from the untreated, i.e. unengraved, surface areas of the printing plate. Deep engraving of the printing plate produces a high embossed relief with a thick ink layer on the printed substrate, while flat engravings produce only a low embossed relief with a thin ink layer. If translucent inks are used, different ink layer thicknesses result in visually contrasting printed surfaces that are distinguishable even when they directly adjoin.

In order to prevent directly adjoining ink layers from flowing into each other along their borderline after being transferred to a data carrier and before the ink has dried, a so-called "separation edge" is integrated into the printing plate between surfaces with different engraving depth. Said separation edge has a tapered, wedge-shaped cross-sectional profile. The tip of the wedge is preferably located at the height of the printing plate surface or slightly thereunder.

The tip of the separation edge profile forms a largely one-dimensional line along the separation edge, similar to a knife edge. It separates the printing plate areas of varying engraving depth but produces no visible interruption of the printed ink surfaces. With the support of the separation edge integrated into the printing plate, the intaglio ink, which is of pasty consistency, is left "standing" in dimensionally stable fashion after being transferred to a substrate even when surfaces printed with varying layer thickness directly abut. In this way, extremely fine, superimposed structures with varying ink layer thickness and high edge sharpness can be printed by intaglio printing.

When engraving the printing plate, the engraving tool is guided so that a tapered separation edge is left standing between the adjoining surfaces having a different engraving depth. If a printed partial surface is completely enclosed by a likewise printed surrounding surface on the substrate, the depression or engraving of the printing plate corresponding to the partial surface must be largely enclosed by a separation edge. Ideally, the partial surface is completely enclosed by the separation edge.

If the engravings of the printing plate are not, or at least partly not, inked, that is, filled with ink, before the printing operation, the noninked area of the printing plate acts only as an embossing plate which can produce so-called blind embossings on a substrate during the intaglio printing operation. The embossed elements have similar proportions and tactile properties, with the exception of the visual impression produced by the ink, as the above-described printed surfaces and partial surfaces.

Further embodiments and advantages of the invention will be explained in the following with reference to the figures. The variants described in the examples relate primarily to very small partial surfaces. The inventively printed surface and partial surfaces can of course also be executed larger, i.e. a few millimeters to centimeters.

DETAILED DESCRIPTION OF THE PREFERRED EMBODIMENTS

Figure 1:
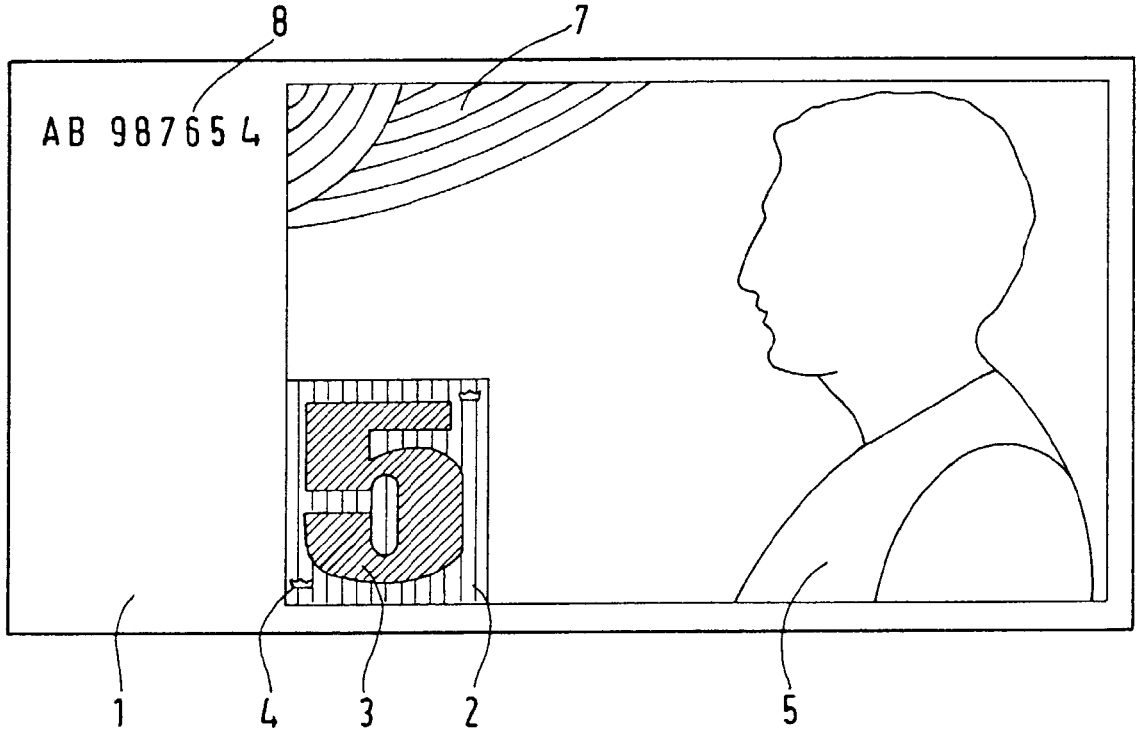
FIG. 1 shows a bank note in a front view.

FIG. 1 sketchily shows a bank note as data carrier 1. A bank note usually has different types of prints. The illustrated bank note shows for example printed image 5 indicating a portrait. Printed image 5 is realized by conventional intaglio printing, which means that different color tones or brightnesses are rendered by line screens with varying line distance or line width. Further, background pattern 7 of fine lines produced by offset and serial number 8 applied by letterpress are present.

In the example shown here, the inventive print is provided only in a partial area of the bank note and consists of surface 2 completely printed with ink and completely enclosing partial surface 3 likewise printed with a unified ink layer. Surfaces 2 and 3 have been printed by intaglio printing with ink layers of varying thickness, which makes them visually distinguishable since there is a brightness or color contrast between surface 2 and partial surface 3. Additionally, printed surface 2 encloses unprinted partial areas 4, which can convey further information if they are designed accordingly.

Figure 2:
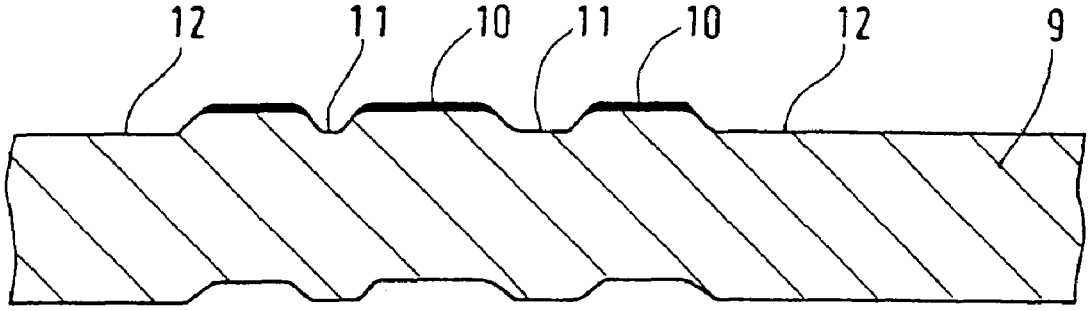
FIGS. 2, 3*a*, 3*b* and 4 show details of printed data carriers in cross section.

In contrast, according to the prior art, information is only represented as printed surfaces against an unprinted background, i.e. in positive representation, or as an unprinted surface against a printed background. FIG. 2 shows in cross section a data carrier area printed according to the prior art, wherein substrate 9 has been printed with ink in spaced-apart surfaces 10. In positive representation, the actual information is rendered by printed surfaces 10 that stand off in high contrast from unprinted surroundings 11 and 12. In negative representation, the information is rendered by unprinted surface areas 11 while printed surfaces 10 form the surroundings and enclose information-conveying unprinted areas 11. Ink-carrying surfaces 10 are usually lines with a width of clearly less than one millimeter in conventional intaglio printing.

Figure 3A:
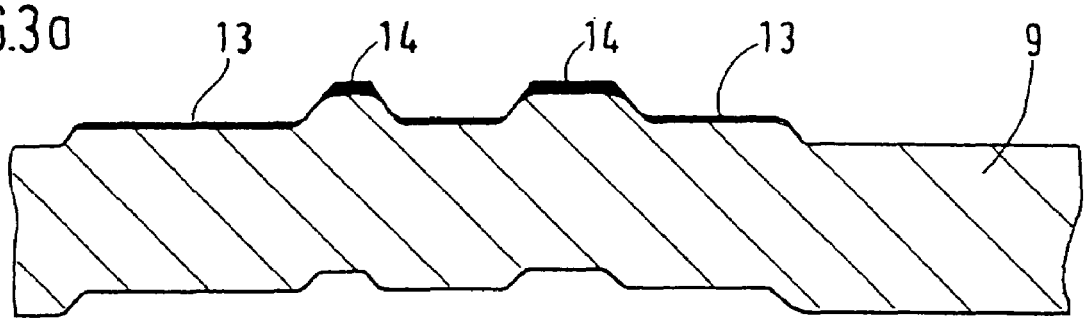
PRIOR ART FIG.3a
Figure 3B:
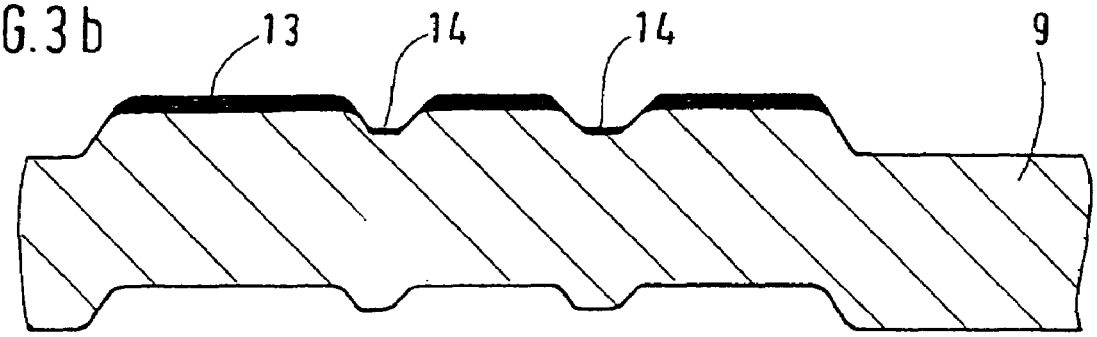

FIGS. 3*a* and 3*b* illustrate the inventive principle of rendering information in a continuously printed surface by selective variation of ink layer thickness between two layer thickness levels. FIGS. 3*a* and 3*b* show in cross section a data carrier area printed according to the invention. In partial surfaces 14 completely enclosed by surrounding print area 13 (which is not recognizable in cross section), the ink layer thickness varies so clearly that a visually well perceptible color or brightness contrast arises between surfaces 13 and 14. In FIG. 3*a*, partial surfaces 14 have a greater ink layer thickness in comparison to their surroundings, while FIG. 3*b* shows the reverse case, i.e. surrounding surface 13 is printed with a thicker ink layer than partial surfaces 14. If transparent ink is used for producing surfaces 13 and 14, the surfaces with the smaller ink layer thickness appear in a lighter color tone. In this case, partial surfaces 14 shown in FIG. 3*a* stand out as darker surfaces against a lighter background, while partial surfaces 14 shown in FIG. 3*b* appear in a lighter color tone than surrounding printed surface 13.

Information can thus be represented by printed, i.e. ink-carrying, partial surfaces 14 against likewise ink-carrying surroundings 13. If the shape and contour of printed surface 13 likewise conveys information, two superimposed pieces of information can be rendered in positive representation on the same surface.

Figure 4:
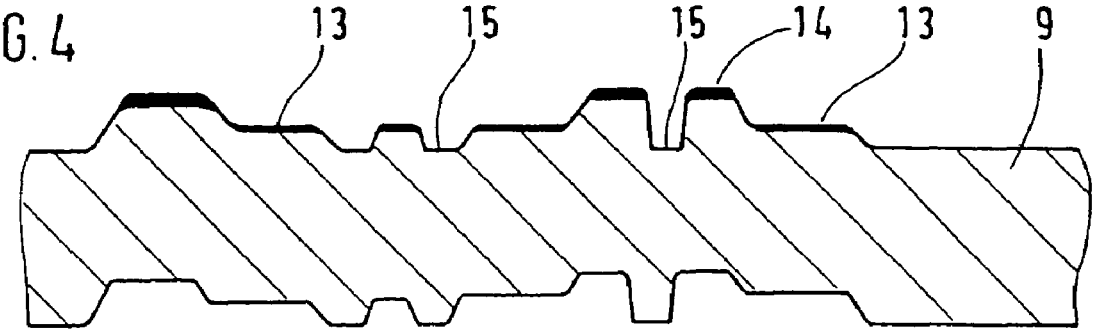

FIG. 4 likewise shows in cross section a detail of an inventive data carrier. Here, the printed surface additionally has unprinted partial areas 15 integrated therein that are completely enclosed by printed surfaces 13 and 14 (which is again not recognizable in cross section). If unprinted areas 15 are designed accordingly, these areas can render further, additional information in negative representation.

The following FIGS. 5 to 9 show enlarged representations of different, preferred embodiments of the invention in a front view. For reasons of clarity, only the printed image produced by intaglio printing according to the invention is shown. The ratios of size of the surfaces to the partial surfaces are rendered realistically.

Figure 5:
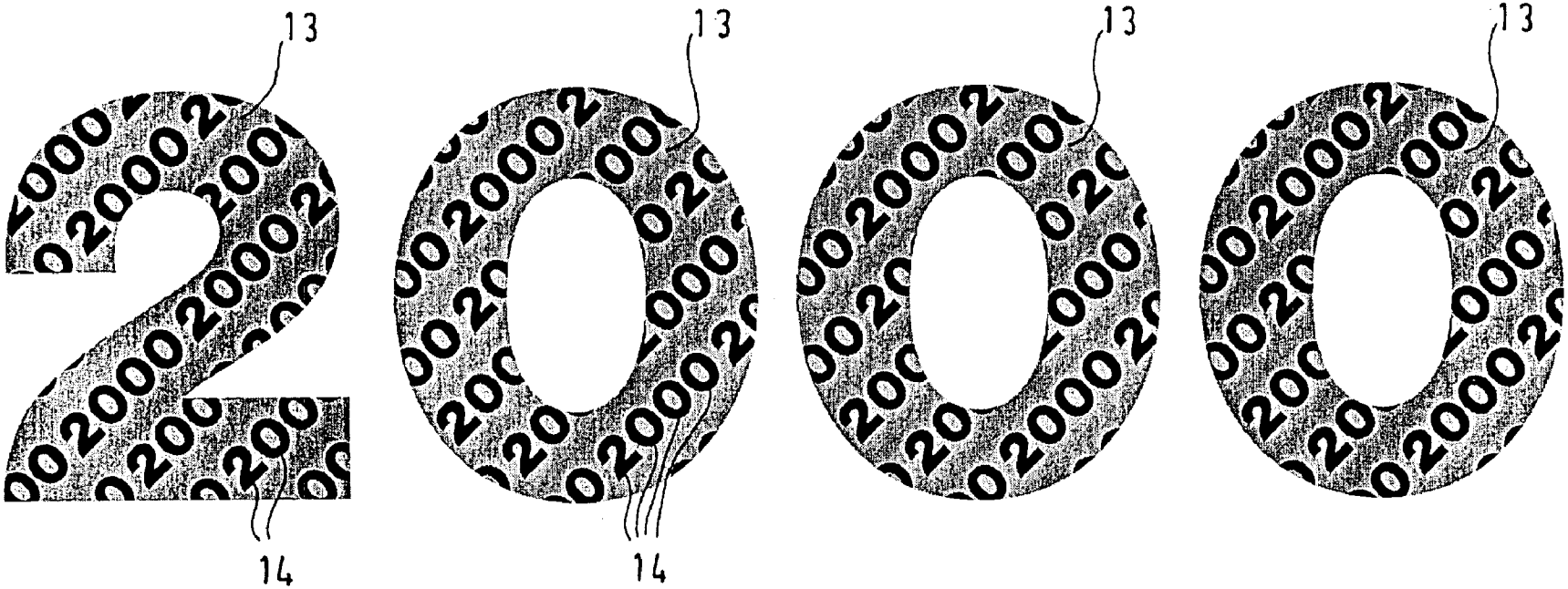
FIG. 5 shows an intaglio print in a front view with two superimposed pieces of information.

In FIG. 5 the number "2000" is rendered, each individual digit being represented by inventively printed surface 13 having a unified ink layer of a certain layer thickness. Each printed surface 13 representing a digit contains partial surfaces 14 enclosed thereby on all sides that have been printed with a thicker ink layer and therefore appear darker. The contour form of partial surfaces 14 is selected in this example so that each partial surface 14 likewise represents a digit. In FIG. 5, the digit sequence of partial surfaces 14 renders the same number as rendered by the sequence of individual print areas 13. Any other signs, patterns or symbols can of course also be used. If surfaces 13 are printed with a printing plate having for example an engraving depth of e.g. 15 microns in the corresponding areas, while the partial areas of the printing plate corresponding to partial surfaces 14 are produced for example with an engraving depth of e.g. 100 microns, not only a visually well perceptible contrast arises between surfaces 13 and 14 of the data carrier but also a feelable level difference. This is because partial surfaces 14 printed by deep engravings produce on the data carrier a raised relief that can be clearly perceived by feeling with the fingertips.

Figure 6:
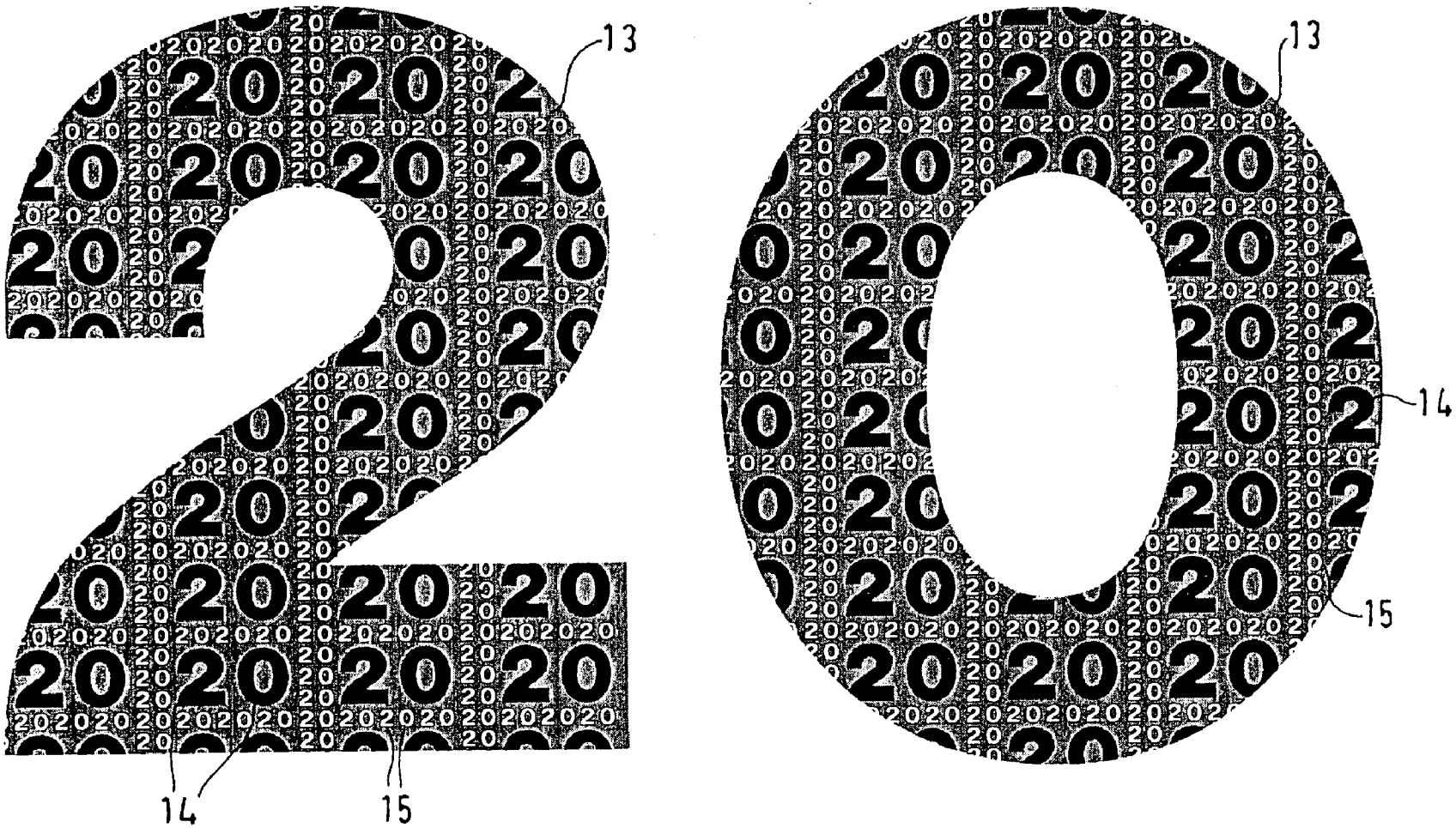
FIG. 6 shows a further intaglio print in a front view with three superimposed pieces of information.

In FIG. 6, the contour form of printed surfaces 13 renders the number "20." Each of the two surfaces 13 represents a digit and contains partial surfaces 14 that are printed with greater ink layer thickness and therefore perceived darker. The form of partial surfaces 14 likewise renders the number "20." Additionally, surfaces 13 printed with the thin ink layer enclose unprinted partial surfaces 15 that are so designed as to likewise render the number "20." Thus, three pieces of information with matching content in the present example are rendered on the same surface. Two pieces of information are rendered in positive representation while the third piece of information is rendered in negative representation. Unprinted areas 15 are disposed like a net within printed surface 13 and frame each partial surface 14.

In preferred embodiments according to the representations in FIGS. 5 and 6, the signs rendered by printed surfaces 13 have a height or size of about one centimeter. Signs of this size are still easy to read at a great viewing distance. Enclosed partial surfaces 14 preferably render signs with a size of about one millimeter. Signs of this size are still easy to read with the naked eye at a normal viewing distance of about 20 to 50 centimeters. If additional signs are integrated by unprinted partial surfaces, they are preferably executed as microwriting. The preferred sign size is only a few tenths of a millimeter. Such microcharacters are only readable without effort with the aid of magnifying means, for example a magnifying glass, and constitute an additional security feature because such fine structures are not resolved with sufficient precision by customary photocopiers and scanners.

Figure 7A:
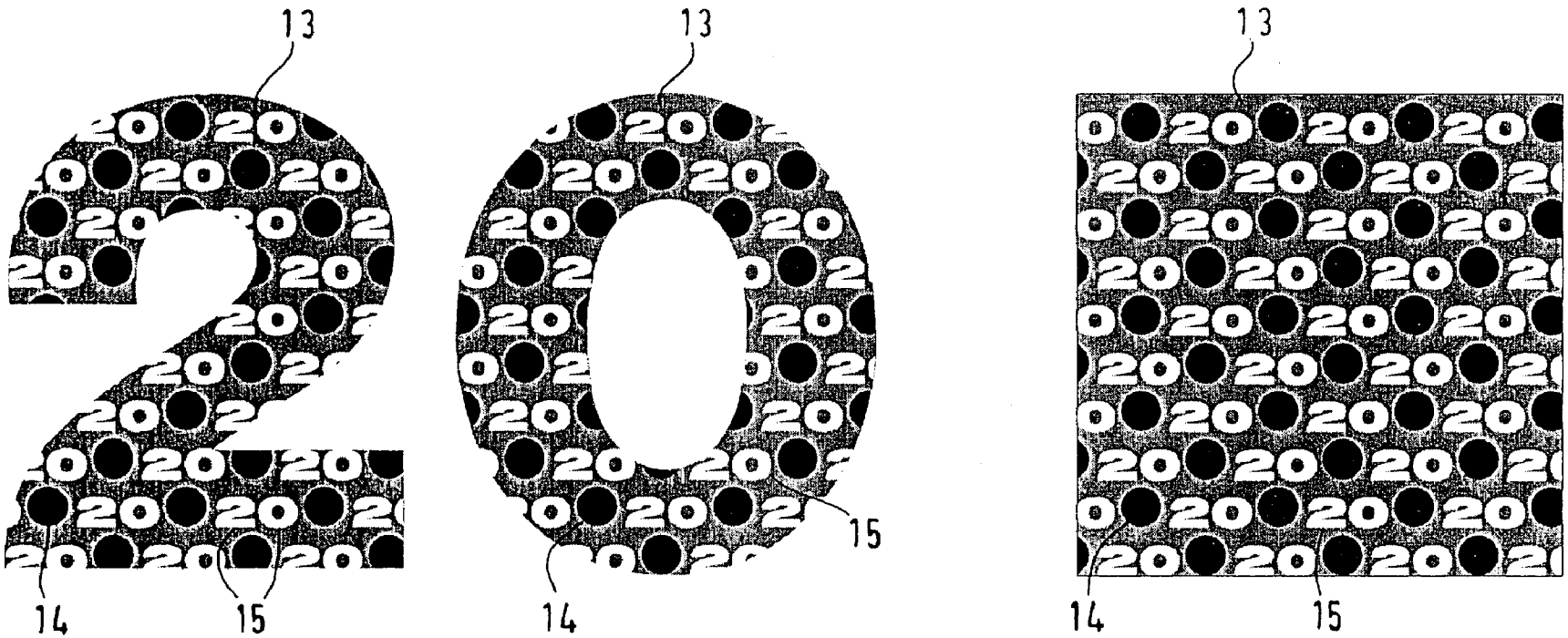
FIGS. 7*a*, 7*b* and 8 show intaglio prints in a front view with superimposed information and surfaces of varying ink layer thickness.
Figure 7B:
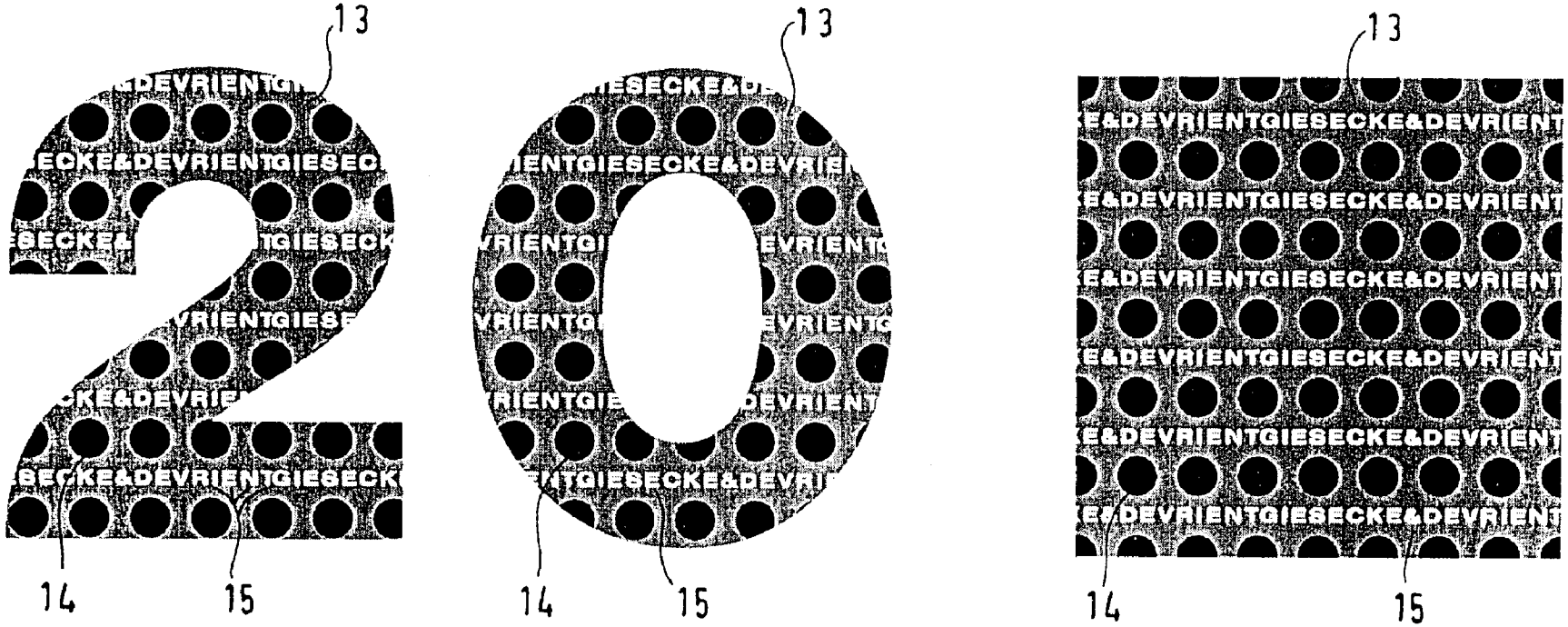

FIGS. 7*a* and 7*b* show two inventive printed images in which printed surfaces 13 render both characters (the digits "2" and "0") and a geometrical element (a square). Printed partial surfaces 14 of this example constitute a surface relief formed especially strongly by embossing and applied ink layer and are therefore perceptible also tactilely. The information represented by partial surfaces 14 corresponds to a simple geometrical element in the form of a circle here.

Suitable elements that are especially well perceptible tactilely are in particular structures with a geometrically simple contour. The size of the feelable elements is preferably a few millimeters and they preferably have a distance apart of at least about 0.5 millimeters. Unprinted partial surfaces 15 integrated into the printed surface render the number "20" in FIG. 7*a*. A further preferred variant not shown in the figure is to render solely the same digit "2" by unprinted partial surfaces 15 in the digit "2" represented by printed surface 13, and accordingly form unprinted partial surfaces 15 like-wise as the digit "0" in the digit "0" rendered by surface 13.

In FIG. 7*b*, unprinted areas 15 have the shape of characters that follow each other in a line and form microwriting. Their information content differs from the information content rendered by printed surfaces 13 and partial surfaces 14. A line of microwriting rendered in negative representation is followed by a line of circles rendered by partial surfaces 14 with a thick ink layer. In FIG. 7*a*, however, the signs rendered by unprinted areas 15 and printed partial surfaces 14 are so disposed as to follow each other alternatingly in both the vertical and the horizontal directions.

Figure 8:
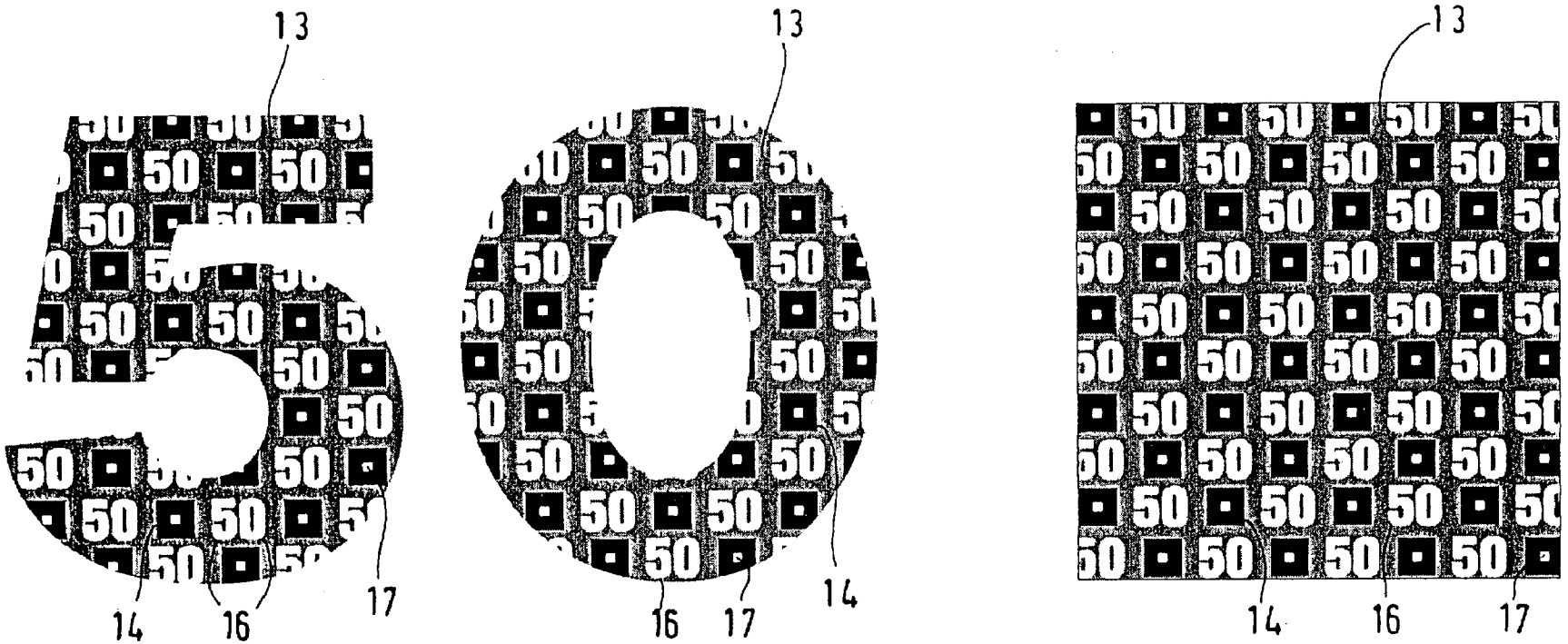

In FIG. 8, the unprinted areas are so disposed in the printed surface that there is both first unprinted areas 16 enclosed by a printed surface with small ink layer thickness, in this case by printed surface 13, and second unprinted areas 17 enclosed by an ink surface with great ink layer thickness, partial surfaces 14 here. In FIG. 8, first unprinted partial surfaces 16 render the digits "5" and "0." Second unprinted partial surfaces 17 as well as printed, dark partial surfaces 14 are executed as squares.

Figure 9:
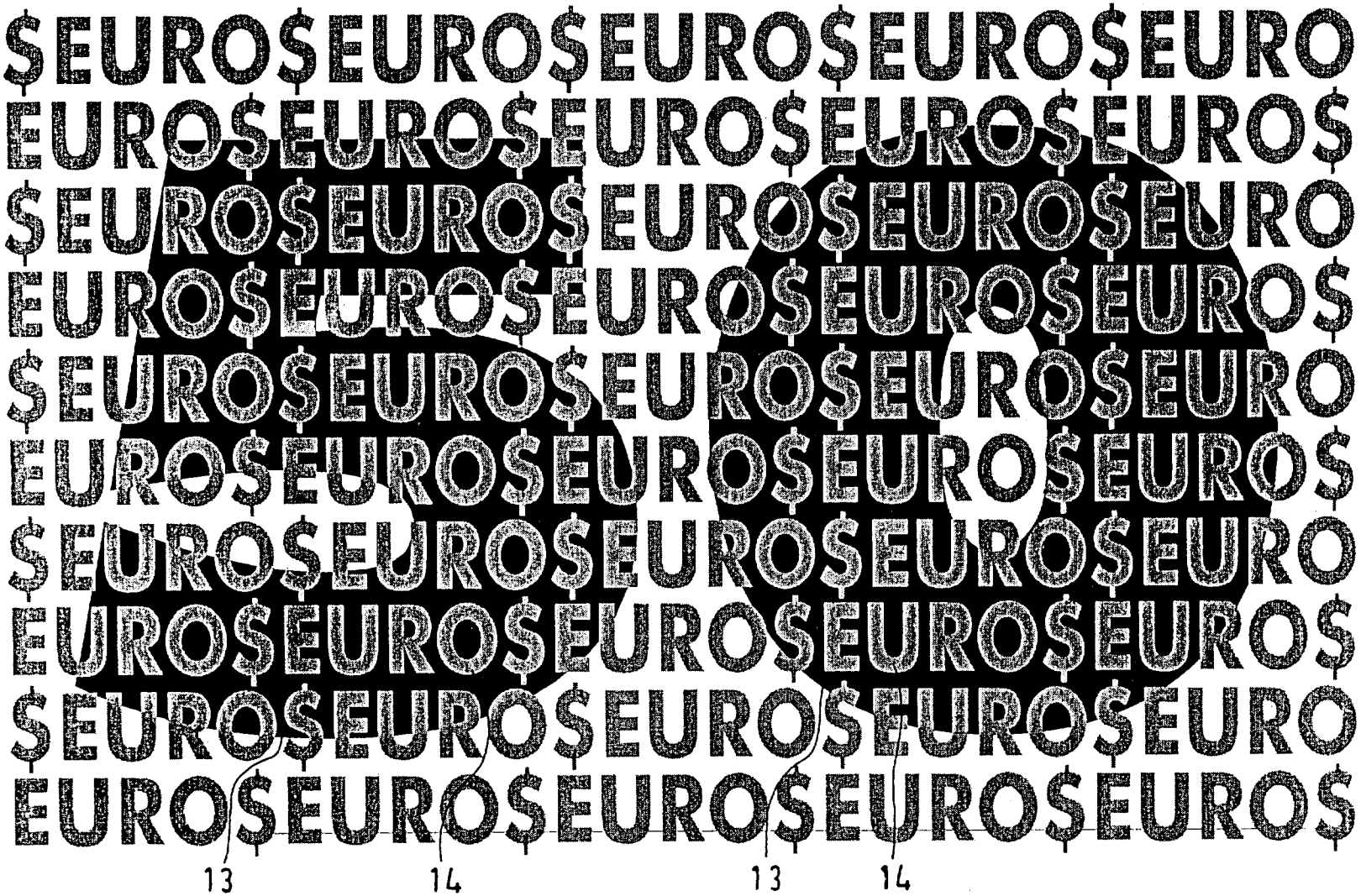
FIG. 9 shows a further intaglio print in a front view with superimposed information in a positive representation.

In FIG. 9, printed, dark surfaces 13 render the digits of the number "50," the visual dark impression being conveyed by a thick ink layer. Partial surfaces 14 enclosed by printed surface 13 have the form of letters together rendering the repeated word "EURO" followed by a "$" sign in each case. They are lighter since they are produced by an ink layer with small thickness. The information formed by partial surfaces 14 within printed surface 13 also extends into the surroundings of printed surface 13. In the shown example, the signs formed within printed surface 13 by printed partial surfaces 14 also extend into the unprinted surroundings of surface 13. This variant can also be used in the other embodiments.

The invention claimed is:

1. A data carrier comprising a background having at least one first surface area completely printed with a unified ink layer and at least one second surface area completely printed with a unified ink layer largely enclosed by said first surface area, wherein the unified ink layers of the first surface area and the second surface area are printed by intaglio printing, the two surface areas having different ink layer thicknesses making them visually distinguishable from each other in that there is a brightness or color contrast between the two surface areas, the first and second surface areas corresponding respectively to distinguishable embossed areas of the data carrier, wherein the completely printed first surface area and the completely printed second surface area are contiguous with one another and form a continuously printed surface.

2. A data carrier according to claim 1, wherein the second surface area is enclosed completely by the first surface area.

3. A data carrier according to claim 1, wherein the first surface area and second surface area are in exact register.

4. A data carrier according to claim 1, wherein the first surface area has a smaller ink layer thickness than the second surface area and is executed so that the background shines through.

5. A data carrier according to claim 1, wherein the second surface area has a smaller ink layer thickness than the first surface area and is executed so that the background shows through.

6. A data carrier according to claim 1, having at least one unprinted area completely enclosed by the first surface area or the second surface area.

7. A data carrier according to claim 1 or 6, wherein the second surface area and/or the unprinted area has the form of a character.

8. A data carrier according to claim 1 or 6, wherein the second surface area and/or the unprinted area has a form selected from the group consisting of a geometrical element, a pictograph and a symbol.

9. A data carrier according to claim 7, wherein a plurality of second surface areas and/or unprinted areas are provided in the first surface area.

10. A data carrier according to claim 9, wherein the second surface areas and/or unprinted areas are executed differently and the information rendered thereby is semantically related.

11. A data carrier according to claim 1 or 6, wherein a contour form of the first surface area renders information.

12. A data carrier according to claim 11, wherein the second surface area and/or the unprinted areas render the same information as the contour form of the first surface area.

13. A data carrier according to claim 1, wherein the first surface area or the second surface area is tactile.

14. A data carrier according to claim 13, wherein the first surface area or second surface area that is tactile has a height of at least 25 microns relative to the data carrier background.

15. A data carrier according to claim 9, wherein at least two second surface areas have different ink layer thicknesses.

16. A data carrier according to claim 1, wherein a plurality of first surface areas are provided and have different contour forms.

17. A data carrier according to claim 1, wherein printed surfaces corresponding to the second surface areas are repeated outside the first surface area so that the information rendered by the second surface areas also extends into the surroundings of the first surface area.

18. A method for producing a printed data carrier comprising the steps of:

printing a substrate by intaglio printing; applying ink in varying ink layer thickness in one printing operation to form a first surface area completely printed with a unified ink layer and at least one second surface area completely printed with a unified ink layer enclosed by the first surface area so that the first surface area and second surface area are distinguishable visually from each other due to a brightness or color contrast between them, the first and second surface areas corresponding respectively to distinguishable embossed areas of the data carrier, wherein the completely printed first surface area and the completely printed second surface area are contiguous with one another and form a continuously printed surface.

19. A data carrier according to claim 13, wherein the first surface area or second surface area that is tactile has a height of at least 40 microns relative to the data carrier background.

20. A data carrier according to claim 1, wherein the data carrier is a bank note, paper of value, or a security document.

21. A method for producing a printed data carrier according to claim 18, wherein the printed data carrier is a hank note, paper of value, or a security document.

* * * * *

UNITED STATES PATENT AND TRADEMARK OFFICE

CERTIFICATE OF CORRECTION

PATENT NO. : 7,618,066 B2
APPLICATION NO. : 10/239179
DATED : November 17, 2009
INVENTOR(S) : Baldus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1451 days.

Signed and Sealed this

Fourteenth Day of December, 2010

David J. Kappos

David J. Kappos
*Director of the United States Patent and Trademark Office*